US005799353A

United States Patent [19]

Oishi et al.

[11] Patent Number: 5,799,353

[45] Date of Patent: Sep. 1, 1998

[54] TOOTHBRUSH

[75] Inventors: Kazumi Oishi, Kusatsu; Atsushi Yamamoto, Takatsuki, both of Japan

[73] Assignee: Sunstar Inc., Osaka, Japan

[21] Appl. No.: 757,237

[22] Filed: Nov. 27, 1996

[30] Foreign Application Priority Data

Dec. 1, 1995 [JP] Japan ..... 7-313890

[51] Int. Cl.[6] ..... A46B 9/04

[52] U.S. Cl. ..... 15/167.1; 15/DIG. 5

[58] Field of Search ..... 15/167.1, DIG. 5

[56] References Cited

U.S. PATENT DOCUMENTS

| | | | |
|---|---|---|---|
| 1,981,657 | 11/1934 | Miller | 15/167.1 |
| 2,209,173 | 7/1940 | Russell | 15/167.1 |
| 2,305,461 | 12/1942 | Spyra | 15/167.1 |
| 3,263,258 | 8/1966 | Burge | 15/167.1 |
| 4,672,706 | 6/1987 | Hill | 15/167.1 |
| 5,628,082 | 5/1997 | Moskovich | 15/110 |

FOREIGN PATENT DOCUMENTS

| | | | |
|---|---|---|---|
| 3528596 | 2/1987 | Germany | 15/167.1 |

*Primary Examiner*—Mark Spisich

*Attorney, Agent, or Firm*—Armstrong, Westerman Hattori, McLeland & Naughton

[57] ABSTRACT

An object of the invention is to provide a toothbrush that effectively removes plaque attached to or deposited on all the regions of tooth surface, interdental space, and cervical margin, and to conduct efficient tooth brushing. To attain the object, at least one of a plurality of tufts constituting the tufting area is wide extending along the longitudinal direction of a tufting base, and the profile of the end portion of the wide tuft is converged toward the end in a shape of dot, line, or plane.

6 Claims, 21 Drawing Sheets

PRIOR ART

TOOTHBRUSH

BACKGROUND OF THE INVENTION

1. Field of the Invention

The present invention relates to a toothbrush that effectively removes plaque attached to or deposited on all portions of tooth surface, interdental space, and cervical margin, and that performs toothbrushing efficiently.

2. Description of the Prior Art

Conventionally known toothbrushes have round tufts b each having a diameter approximately ranging from 1.6 to 2.0 mm to structure the tufting area a, which tufts are arranged at a specified spacing c, as illustrated in FIG. 27. Most of the known toothbrushes have a flat tip profile of the tuft or a unidirectionally skewed tip profile on every tuft. That type configuration of these known toothbrushes comes from the method for implanting the tufts thereinto.

For implanting tufts, firstly a tufting base having tufting holes is prepared by injection molding method, then a small metallic jig called the anchor is pressed against each of the tufts having specified length to let the tuft implant into each of the tufting holes along with the anchor while folding the tuft into U-shape. Both ends of the anchor is forcibly wedged into a part of peripheral wall of the tufting hole to fix the anchor thereto, then the irregular tip of the tuft is cut to make even the tip-profile of the tuft.

Since the conventional toothbrushes secure the fixation of tufts by forcibly wedging the ends of anchor into the peripheral wall of the corresponding tufting holes, degradation of mechanical strength of the tufting base becomes a problem. To maintain a specified mechanical strength of the tufting base, the size of the tufting hole needs to be at or below the specified diameter. Accordingly, a specific space between adjacent tufting holes is necessary to be maintained.

Further, since cutting of tuft tip portion is performed on each of the densely gathered tufts within the tufting area after the fixation of the tuft, the cutting to form a complex profile is difficult. Consequently, most of conventional working surfaces are either the flat one parallel to or the unidirectionally skewed one to the face of head part of handle.

Those types of conventional toothbrushes have the following problems. As shown in FIGS. 28 and 29, since the area occupied by the space c is large in the total tufting area, the contact between the tooth surface A and the tuft b is insufficient. In addition, since each tuft has round cross section giving no directional orientation and since each tuft has a diameter approximately ranging from 1.6 to 2.0 mm, there is a defect that the whole tuft group is inferior in hardness resulting in poor brushing efficacy on the tooth surface and in poor durability.

As a toothbrush proposed to solve the above-mentioned problems, the one disclosed in Japanese Unexamined Utility Model Application No. Sho. 63-99527 is known. This toothbrush is configured such that at least one of the tufts implanted into the tufting base is formed into a wide tuft which extends to the whole width or to the whole length of the tufting base. With this arrangement, the contact area between the tuft and the tooth surface is increased and the mutual supporting effect of densely gathered filaments is enhanced, to thereby increase the hardness of tuft and improve the plaque removal efficacy on the tooth surface and the durability of tuft.

Further, by utilizing the difference of hardness between the wide tuft and the ordinary round tuft, the wide tuft having higher hardness placed adjacent to the round tuft, which is warped by contacting the tooth surface, is enabled to position at cervical margin and interdental space, thereby enabling scraping out the plaque deposited at a deep region of cervical margin and interdental space.

By locating a wide tuft extending to whole width or whole length of the tufting base, the improvements of plaque removal efficacy and durability are attained. Nevertheless, the plaque removal efficacy on interdental space and cervical margin is not satisfactory. That is, that type of toothbrush allows easy insertion of the wide tuft having high hardness into the cervical margin by warping the round tufts adjacent to the wide tuft. However, as shown in FIGS. 29 and 30, the interdental space B and the cervical margin C are unexpectedly deep and narrow, so that it is not easy to make the tuft tip to reach the deepest part of the interdental space and the cervical margin even when the wide tuft is attached to the dentition to let the wide tuft enter into the interdental space B and the cervical margin C.

In addition, that type of toothbrush has a wide tuft extending to whole width or whole length of the tufting base, and the filaments are densely gathered in a continuous style for over the width of a single tooth. Therefore, the number of filaments which come to the opening of interdental space B tends to exceed the number actually allowed to enter. As a result, there is a problem that the filaments clog the inlet of the interdental space, resulting in fail to make the tip of filaments reach the deepest part of the interdental space.

Further, since the toothbrush of this type has the wide tuft extending to whole width or whole length of the tufting base, so that the hardness of the wide tuft tends to become excessive. Accordingly, there is a problem that particularly when the wide tuft extends to the whole length of the tufting base, the tuft loses its adequate flexibility to give elastic deformation which conforms to the undulation of the dentition surface, and a gap appears between the tooth surface and the tuft, resulting in degradation of effect of simultaneous brushing on teeth.

Furthermore, since that type of toothbrush has a wide tuft which is not divided into separate tufts, air permeability of the tuft is poor and drying thereof is difficult, and further the removal of food residue attached to the tufting area is difficult. As a result, there is a problem that the tufts at inner rows are likely contaminated.

Still further, to improve the interdental space cleaning effect, an angular profile brush is proposed in Japanese Unexamined Utility Model Application No. Sho. 62-102432, Japanese Unexamined Utility Model Application No. Sho. 62-106522, and United States Design Patent (USD) No. 332,873. In that type of toothbrush, however, two tufts form a single angle profile. Accordingly, since there is a space between mutual holes to tuft and there is a relatively large space between tufts, the contact area with tooth surface is similar with that of conventional toothbrush. Therefore, actual result of plaque removal efficacy is not satisfactory.

BRIEF SUMMARY OF THE INVENTION

The present invention was completed in view of the state described above. Therefore, an object of the present invention is to provide a toothbrush which enhances the accessibility of wide tuft to cervical margin and to interdental space while maintaining the effect of tooth surface brushing by the wide tuft, and performs the removal of plaque deposited on these portions effectively, and which has a plaque removal efficacy for all the regions of tooth surface, cervical margin, and interdental space, and has a good toothbrushing effect.

Another object of the present invention is to provide a toothbrush having an optimum arrangement of wide tufts to attain the balanced plaque removal efficacy on the above described portions without sacrificing the effect of simultaneous brushing of a plurality of dentition.

According to the present invention which achieved to solve the above-described problems, there is provided a toothbrush having a tufting area at a head part of a handle, characterized in that the tufting area comprises a plurality of tufts in which at least one of the tufts is wide along the longitudinal direction of a tufting base on the tufting area and the profile of tip portion of the tuft is converged toward the tip having a shape of dot, line, or plane. The converged profile described above is assumed, for example, a plurality of skewed surfaces surrounding the cross section of the tuft while converging toward the top edge, or what is called roof shape in Japanese house.

An adequate range of profile and size of the converging portion formed at the tip-portion of the wide tuft is determined depending on the interdental gap and depth at the target region for brushing. In general, the size range of the converging portion is that the size of the tip profile is larger than 0 mm and not larger than 8 mm in major axis (w) and larger than 0 mm and not larger than 3 mm in minor axis (d), and that the size of the root of the converging portion is from 3 to 10 mm in major axis (W) and from 1 to 3 mm in minor axis (D), and that the height (h) of the converging portion is from 0.5 to 4 mm.

The wide tufts having converged tip-portion are preferably arranged at outermost periphery of the tufting area along the outer profile of the tufting base.

Filament structuring the wide tuft may be thinner than the filament in other tufts.

A preferable example of toothbrush is the one having a plurality of wide tufts each of which has a converging portion at a tip portion thereof to converge toward the tip having a shape of dot, line, or plane, and which plurality tufts are arranged on both lateral sides of the tufting base along the outer profile thereof while directing the wide face of the tuft in the longitudinal direction of the tufting base, wherein the size of a tip portion of the wide tuft is larger than 0 mm and not larger than 8 mm in major axis (w) and larger than 0 mm and not larger than 3 mm in minor axis (d), and the size of the root of the converging portion of the wide tuft is from 3 to 10 mm in major axis (W) and from 1 to 3 mm in minor axis (D), and the height (h) of the converging portion is from 0.5 to 4 mm, and wherein a plurality of round tufts each of which has 1.6 to 2.0 mm of root diameter are arranged along the longitudinal direction of the tufting base at a lateral intermediate position between the wide tuft rows. The term "larger than 0 mm" given as the lower limit of major axis and minor axis of the tip-portion size described in the above-given figures is assumed that only a single filament exists at the tip of the tuft in each described side.

It is more preferable that the tip of the tufting base has a tip-thinning round edge, wherein three tufts each of which has 4.0 to 10.0 $mm^2$ of root area are arranged at the tip-thinning edge part in a triangle arrangement while placing the apex of the triangle arrangement comes to the tip of the round edge of the tufting base.

A profile of converging portion formed at the tip-portion of the wide tuft may adopt the one, for example, converging starting from outer periphery of the tuft and converging toward a single point following a smooth curve to form a nearly hemispherical converging portion.

Since an area where wide tufts are arranged in place of conventional round tufts has no wide gap which was seen in conventional round tuft arrangement, so that the wide tufts simultaneously touch the whole teeth surface, and efficient cleaning of the tooth surface is achieved. Also, since the tip-portion of the tuft is converged, the tip of tuft readily reaches interdental space and cervical margin, thus the plaque deposited on these regions is easily scraped out.

The number of filaments structuring the wide tuft is larger than that of the round tuft. Since these many filaments support one another, the tuft increases its stiffness and becomes durable. Accordingly, the tip of the converging portion formed at the tip portion of the wide tuft readily reaches the deep portion of cervical margin and interdental space. In addition, since the wide tuft simultaneously touches a plurality of cervical margins, the removal of plaque deposited on the cervical margins is performed efficiently.

When the tip size and height of the converging portion are specified in accordance with the second aspect of the invention responding to the relation with the size of target tooth, brushing with the toothbrush according to the present invention by the scrubbing method allows the tip portion of the converging portion to enter into the interdental space smoothly and allows to reach the deepest part of the interdental space. At the same time, the filaments which are densely gathered within a range defined by the size of the root of converging portion forcibly enter the interdental space to remove the plaque deposited thereto by the strong rubbing action of the filaments against the inner wall surface of the interdental space.

When the wide tufts having converging portion are arranged at outermost periphery of the tufting area along the outer profile of the tufting base, the wide tufts contact the cervical margin smoothly.

If the filament structuring the wide tuft is thinner than the filament of other tufts, the wide tuft provides a soft touch and has strong stiffness. Therefore, the tuft performs excellent plaque removal efficacy while suppressing excessive stimulation to gingiva.

Further, when approximately hemispherical converged portion is formed on the tip of wide tuft, the spherical surface touches gingiva to press a relatively wide area thereof without damaging the gingiva. Therefore, an excellent massage efficacy is provided, and an excellent cleaning effect is given to the interdental papilla.

DETAILED DESCRIPTION OF PREFERRED EMBODIMENTS

Figure 1:
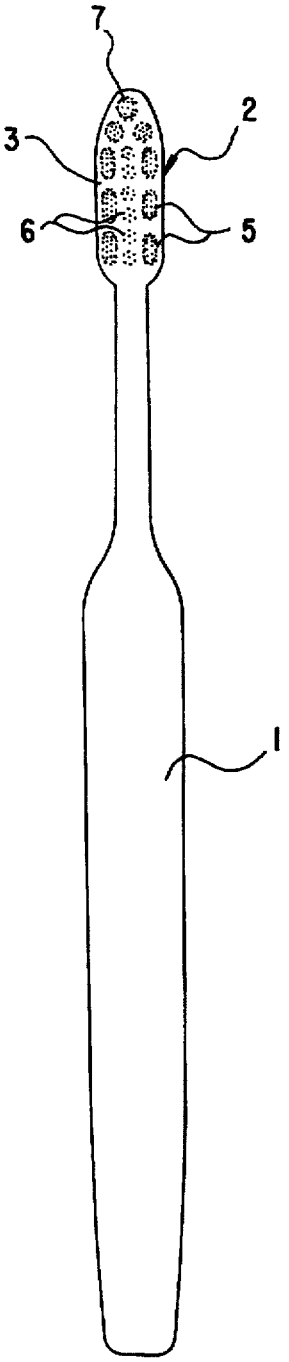
FIG. 1 is a front view showing a typical example of toothbrush according to the present invention.

Next, the present invention is described in more detail with reference to the accompanying drawing. FIG. 1 is an entire view showing a toothbrush according to the present invention having a tufting area 2 at the tip portion of the handle 1.

Figure 2:
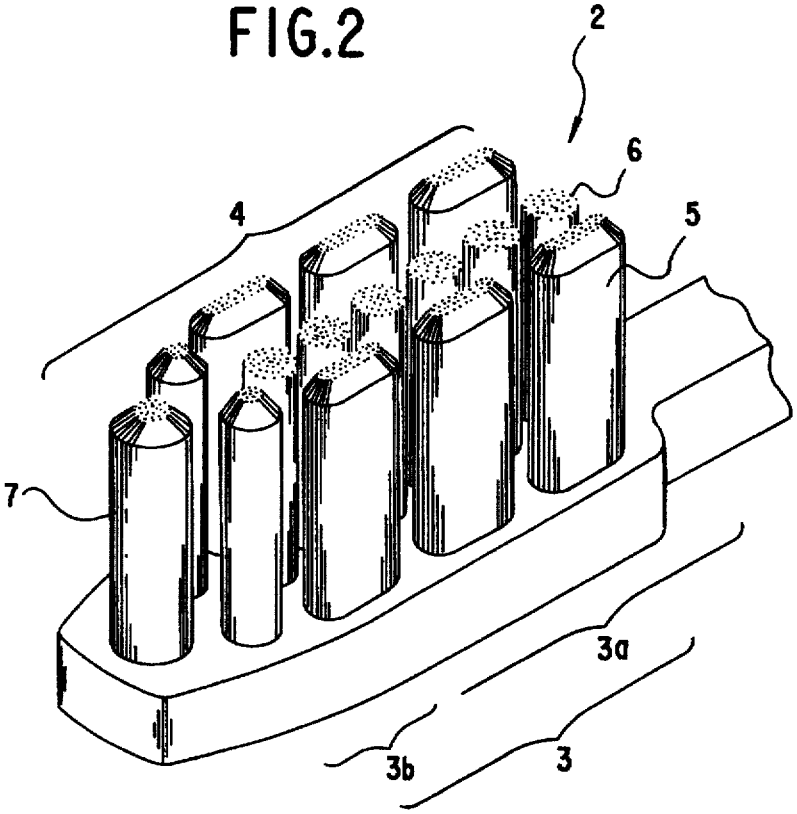
FIG. 2 is a perspective view showing a tufting area of the toothbrush in FIG. 1.
Figure 3:
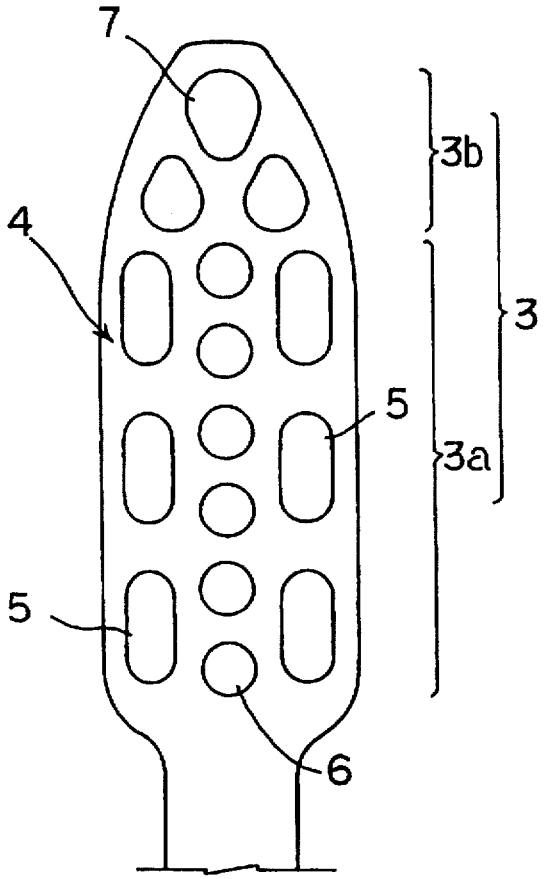
FIG. 3 is a front view showing the tufting area of the toothbrush in FIG. 1.
Figure 4:
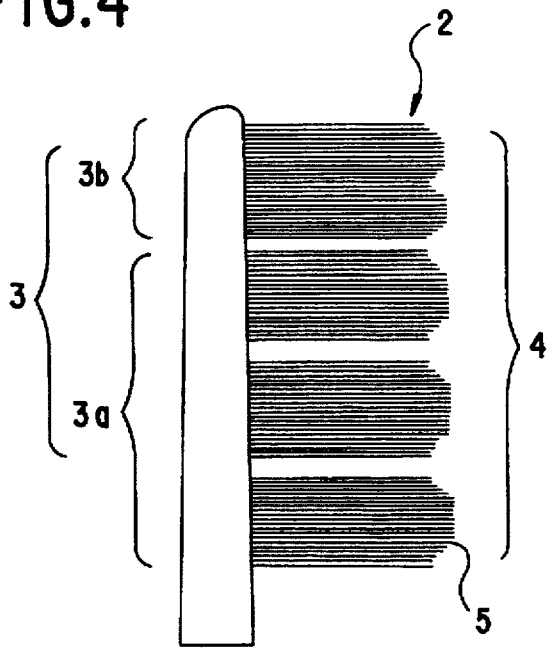
FIG. 4 is a side view showing the tufting area of the toothbrush in FIG. 1.
Figure 5:
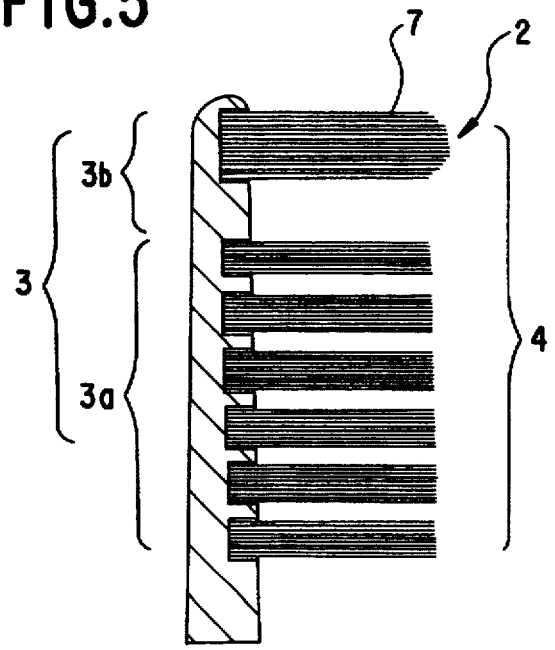
FIG. 5 is a vertical sectional view showing the tufting area of the toothbrush in FIG. 1.

FIG. 2 is a perspective view of the tufting area 2. FIG. 3 is a front view showing the tufting area 2 where description of filaments is omitted. FIG. 4 is a side view showing the tufting area. FIG. 5 is a vertical sectional view showing the tufting area along the lateral center line thereof. The tufting area 2 consists of a tufting base 3 and a group of tufts 4 vertically implanted into the tufting base 3. The tufting base 3 consists of a body portion 3*a* and a tip-thinning portion 3*b* with a rounded profile.

The tuft group 4 consists of three rows arranged in the lateral direction of the body portion 3*a* of the tufting base 3, and the tuft is wide along the longitudinal direction of the tufting base 3 while arranging the wide tufts 5,5, . . . , which have converged tip portion, along the outer profile of the tufting base 3.

Implanting that type of wide tufts 5 into the tufting base 3 is readily performed by positioning every tuft which was profiled with a plurality of skewed surfaces surrounding the cross section of the tuft while converging toward the top edge thereof, or what is called roof shape in Japanese house, in a die for molding the tufting base, and by integrating the root of the tuft with the tufting base 3 using a synthetic resin injected into the die. The implanting method differs from conventional piling method in which the tuft is piled into the tufting hole using an anchor.

Although not shown, other method may be applied. For example, the neck of the tuft to be implanted is fused with the surface of the tufting base which accepts the tuft, and the tuft is welded to the surface of the tufting base.

Figure 6A:
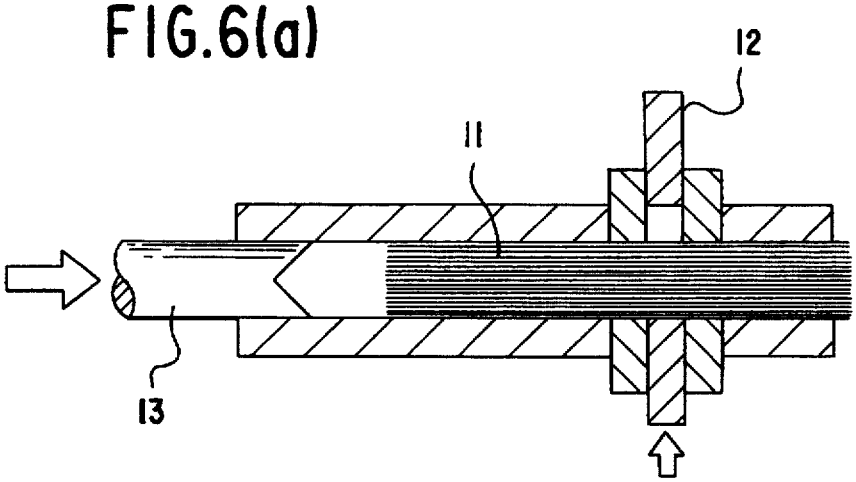
FIGS. 6(*a*) to 6(*c*) illustrate individual stages for preparing profile of the tip of a tuft.
Figure 6B:
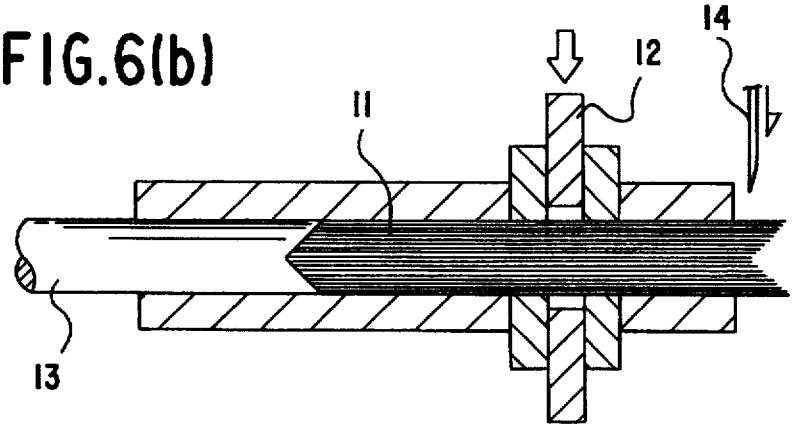
Figure 6C:
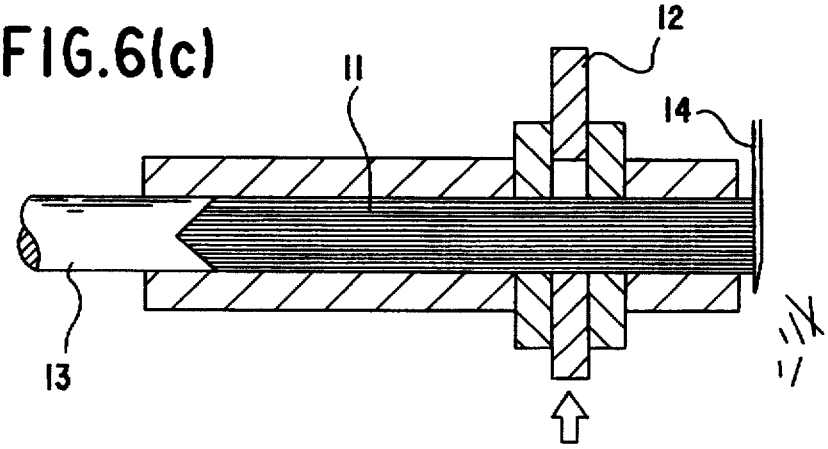

Profiling the tip portion of the tuft is conducted by, for example, a method illustrated by FIGS. 6(*a*) to 6(*c*). The method comprises: (1) the step for inserting a tuft 11 into a cylinder which is provided with a clamp 12 at a midway in the longitudinal direction thereof, which clamp 12 stops and releases the front/rear movement of the tuft 11 by the vertical movement, (FIG. 6(*a*)); (2) the step for releasing the tuft 11 from the state of fixing by the clamp 12 and for profiling the tip portion of the tuft in roof shape by pressing a profiling rod 13 against the tip of the tuft, which profiling rod has a tip portion in a counter-shape to the target profile of the tuft tip, (FIG. 6(*b*)); and (3) the step for holding the tuft 11 by vertical movement of the clamp 12 and for cutting the neck portion of the tuft by a cutter 14 into even the root of the tuft, (FIG. 6(*c*)).

As shown in FIGS. 1 to 4, the area between the wide tufts 5, has a plurality of round tufts 6 each having a neck diameter ranging from 1.6 to 2.0 mm. The illustrated example has only a single row of the round tufts 6 in the center of the lateral width direction of the tufting base. However, the round tufts may be arranged in plural rows.

At the tip-thinning portion 3*b* of the tufting base, three tufts 7, 7, 7, each of which has a large neck area ranging from 4.0 to 10.0 $mm^2$ are arranged in a triangle arrangement while placing the apex of the triangle arrangement comes to the tip of the triangle edge of the tufting base. The large neck area tufts 7, 7, 7 are in an oval shape in FIG. 3, though they may be in a round shape.

Figure 7:
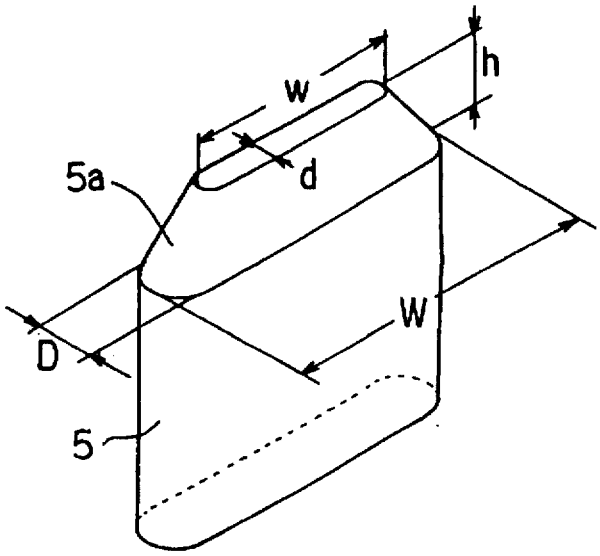
FIG. 7 is a perspective view showing a wide tuft.

Detail of the wide tuft 5 is shown in FIG. 7. The wide tuft 5 has a stereoscopic shape with elliptical section at its implanting neck portion and roof profile at its end portion. The converging portion 5*a* is configured by extending the filaments longer toward inside of the tuft. The neck size and shape of the converging portion 5*a* are the same as those of the above-described neck of the tuft at its implanting section. All the filaments in the tuft are vertically stood from the tufting base. However, the filaments may be inclined toward the center of the tuft (not shown).

Figure 8:
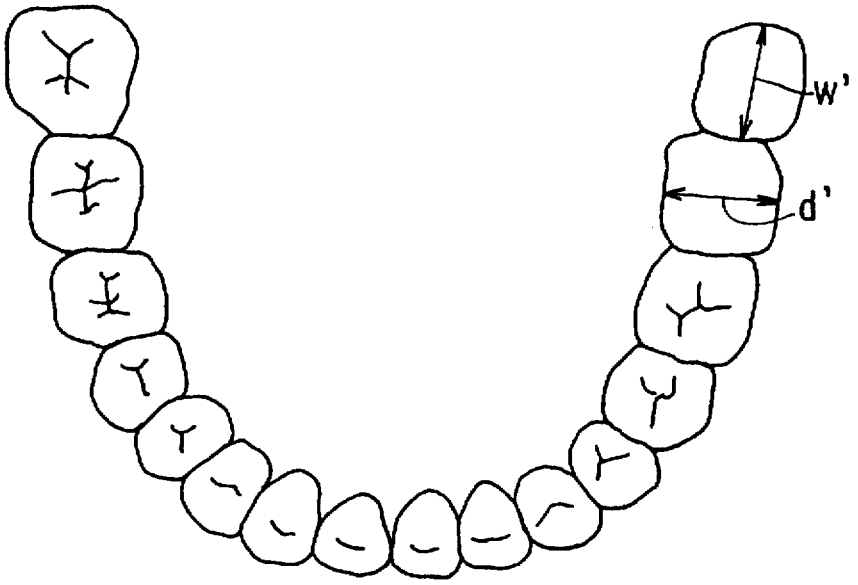
FIG. 8(*a*) illustrates width and thickness of tooth, and FIG. 8(*b*) illustrates height of tooth.
Figure 8:
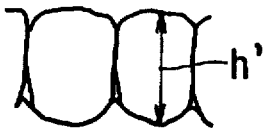
Figure 9A:
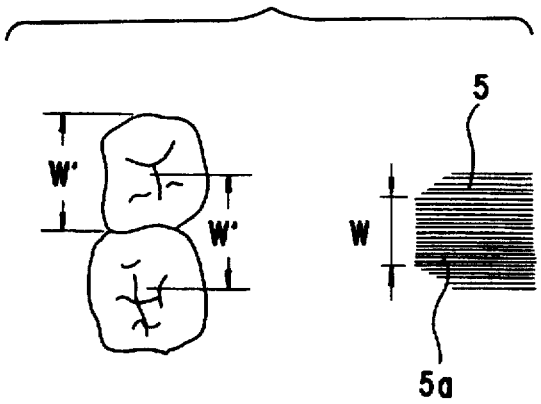
FIG. 9(*a*) illustrates a dimensional relation of tooth width, teeth pitch, and converging portion of a wide tuft, and FIG. 9(*b*) illustrates the state that the converging portion touches the teeth surface.
Figure 9B:
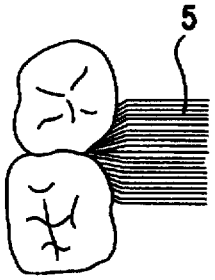

The dimensions of the end portion of converging portion 5*a*, namely major axis (w), minor axis (d), and converging portion height (h), are determined taking into account of the size of tooth shown in FIGS. 8(*a*) and 8(*b*) and FIGS. 9(*a*) and 9(*b*). As shown in FIG. 8(*a*), the definition is given as (w') for the tooth width along the dentition, (d') for the tooth depth in the direction of crossing the tooth width direction nearly orthogonally, and (h') for the tooth height which corresponds to the length of tooth exposed on the gingiva as shown in FIG. 8(*b*). Then, the average dimensions of the tooth crown on a permanent tooth expressed by the function of these height (h'), width (w'), and depth (d') are given in Table 1, which expression is in accordance with the "Anatomy of Teeth", Dr. Kotaro Fujita, (Kinbara Publication Co., Ltd.) Thus, the total average of each of height (h'), width (w'), and depth (d') becomes h'=8.5 mm, w'=8.3 mm, and d'=8.9 mm.

TABLE 1

List of average dimensions of crowns on permanent teeth (Unit: mm)

| | Central incisor | Lateral incisor | Canine | First premolar | Second premolar |
|---|---|---|---|---|---|
| Upper jaw | | | | | |
| h' | 11.7 | 9.6 | 10.9 | 8.4 | 7.6 |
| w' | 8.6 | 6.9 | 7.9 | 7.3 | 6.9 |
| d' | 7.2 | 6.1 | 8.3 | 9.4 | 9.3 |
| Lower jaw | | | | | |
| h' | 9.1 | 9.2 | 10.3 | 8.4 | 7.7 |
| w' | 5.4 | 6.1 | 6.7 | 7.1 | 7.4 |
| d' | 5.7 | 6.2 | 7.6 | 7.7 | 8.3 |

| | First molar | Second molar | Third molar |
|---|---|---|---|
| Upper jaw | | | |
| h' | 7.2 | 7.0 | 6.0 |
| w' | 10.6 | 9.6 | 8.9 |
| d' | 11.8 | 11.6 | 10.6 |
| Lower jaw | | | |
| h' | 7.9 | 7.2 | 7.1 |
| w' | 11.4 | 11.6 | 10.5 |
| d' | 10.8 | 10.9 | 10.1 |

| | Upper jaw average | Lower jaw average | Front teeth average | Back teeth average | Total average |
|---|---|---|---|---|---|
| h' | 8.6 | 8.4 | 10.1 | 7.5 | 8.5 |
| w' | 8.3 | 8.3 | 6.9 | 9.1 | 8.3 |
| d' | 9.3 | 8.4 | 6.9 | 10.1 | 8.9 |

Note: The front teeth average deals with canine, and the back teeth average deals with premolar and molar.

Interdental width is assumed as the same as the center distance between adjacent teeth, which is illustrated in FIG. 9(*a*). If the size of adjacent teeth is nearly equal to each other, the center distance between adjacent teeth becomes nearly equal to the tooth width (w'), so that the interdental width can be expressed by the dimension (w').

Since the interdental depth may be assumed as a half of the tooth depth (d') at the most, or (d'/2), the interdental depth can be expressed by the dimension (d'/2).

When these interdental width (w') and interdental depth (d'/2) are taken into account, the dimensions of major axis (w) and minor axis (d) at the end of a converging portion 5*a*, height (h) of the converging portion 5*a*, and major axis (W) at the neck of the converging portion 5*a* are determined as follows.

Regarding the size of the end portion of the converging portion 5*a*, the major axis (w) is larger than 0 mm and not larger than 8 mm. When a tooth having minimum interdental width (w') is considered, a preferable major axis (w) is larger than 0 mm and not larger than 5 mm, and a preferable minor axis (d) is larger than 0 mm and not larger than 3 mm. When the capability of insertion into interdental space and cervical margin is considered, a preferable minor axis (d) is larger than 0 mm and not larger than 1 mm. Since the average of interdental width (w') is 8.3 mm, if only the major axis (w) at the converging portion 5*a* is 8 mm or less, the converging portion 5*a* smoothly comes into interdental space as shown in FIG. 9(*a*) and FIG. 9(*b*). The height (h) of the converging portion 5*a* is in a range of from 0.5 to 4 mm. Although the average of interdental depth (d'/2) is 4.45 mm, the height (h) of the converging portion 5*a* is set to slightly smaller than the value of interdental depth (d'/2). The reason of setting smaller than the interdental depth (d'/2) is to enhance the plaque removal efficacy by entering the converging portion 5*a* into interdental space and also to forcibly introduce the portion of densely gathered filaments into the interdental space succeeding to the converging portion 5*a*. By the forceful introduction of the portion of densely gathered filaments succeeding to the converging portion 5*a* deep into the interdental space, the plaque deposited on the inside wall surface of the interdental space is effectively removed by the strong rubbing action of the forcibly entered filaments against the inside wall surface of the interdental space. For fully performing of the rubbing action of the forcibly introduced filaments, the major axis (W) at the root of the converging portion 5*a* is preferably set to slightly larger than the interdental width. The upper limit of the major axis (W) at the root of the converging portion 5*a* is around 10 mm. If a tooth has the smallest interdental width (w'), most preferable upper limit of the major axis (W) is around 6 mm. If the major axis (W) exceeds 10 mm, the portion of densely gathered filaments become difficult to enter succeeding to the converging portion 5*a* because individual filaments hinder one another in their way. When the major axis (W) is taken as 6 mm or less, the portion of densely gathered filaments smoothly enters interdental space for all sizes of teeth. The rubbing action induced by the introduction of the portion of densely gathered filaments is not necessarily required for all interdental spaces, and a shallow interdental space does not need such an action. Accordingly, for a shallow interdental space, the major axis (W) of 3 mm or more is sufficient in practical use. The reason why the lower limit of the major axis (W) is set to 3 mm is that the major axis (W) lower than 3 mm provides too thin thickness of tuft, which reduces the contact area against interdental space and cervical margin, and results in degradation of cleaning effect and in poor stiffness of tuft. Therefore, the major axis (W) at the root of the converging portion 5*a* is specified to a range of from 3 to 10 mm. If only the major axis (W) is in a range of from 3 to 10 mm, the individual wide tufts 5 show adequate elastic deformation conforming to the undulation of the dentition surface.

In the above-description, the lower limit of the major axis (w) and minor axis (d) at the tip of the converging portion 5a is "larger than 0 mm". The expression is based on the assumption that the tip of the converging portion may be structured by only a single filament on both or either one of the major axis direction and the minor axis direction. The present invention deals also with the tuft that has an end having a shape of dot or line. When, however, the tip becomes a dot shape, the capability of insertion into interdental space and cervical margin is improved, but the contact pressure of the tip against a tooth decreases to tend to degrade the strong brushing effect on the target region (hereinafter referred to simply as "brushing effect"). Although a line shaped end which has a minor axis (d) near to 0 mm provides favorable insertion into cervical margin, the brushing effect tends to degrade as in the case of dot shaped end. Accordingly, the minor axis (d) is preferably increased within a range not to degrade the capability of insertion, and the upper limit of the minor axis (d) is around 3 mm.

Too short minor axis (D) at the root of the converging portion 5a fails to provide sufficient stiffness in the minor axis direction. When the minor axis (D) exceeds 3 mm, the stiffness becomes too strong, and the arrangement of three rows or more in lateral direction on the tufting base becomes difficult. In this respect, the side dimension within a range given above allows favorable brushing to remove plaque attached to the tooth surface without damaging gingiva using ordinary nylon filament having a size of 8 mil (1 mil=0.0254 mm).

The filament structuring a wide tuft 5 is preferably thinner than the filament structuring the round tuft 6. Since the wide tuft contains lots of filaments, thinner filament can also maintain the hardness of the whole tuft. Therefore, the efficient removal of plaque attached to the tooth surface is attained while providing the soft touch on the gingiva.

According to FIGS. 1 to 4, the wide tuft 5 has the dimensions of major axis (W) of 4.6 mm and minor axis (D) of 1.6 mm. Three tufts are arranged in the longitudinal direction of the tufting base. The number of wide tufts 5 along the longitudinal direction of the tufting base is not limited to three. Nevertheless, for the wide tuft 5 having the above-described dimensions, the number is preferably 3 or less.

Figure 10:
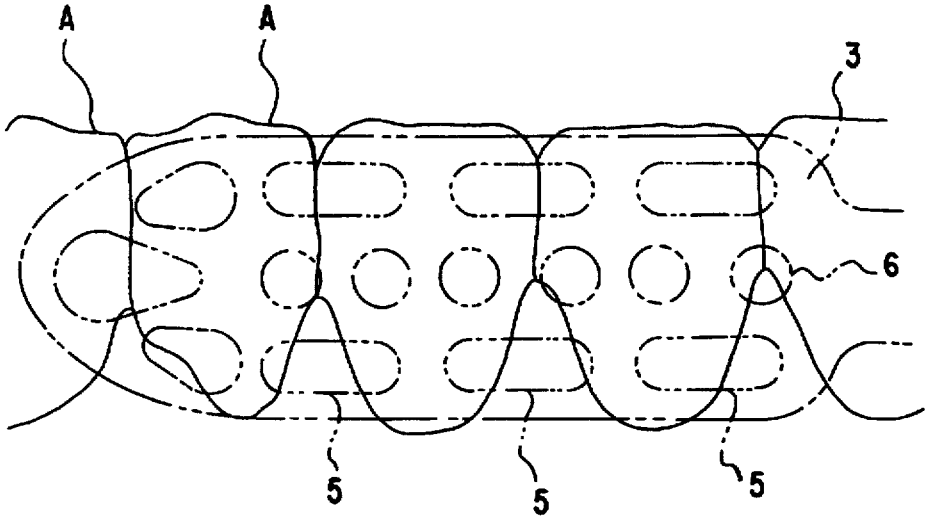
FIG. 10 is a front view illustrating the state that the tufting area touches the teeth surface.
Figure 11:
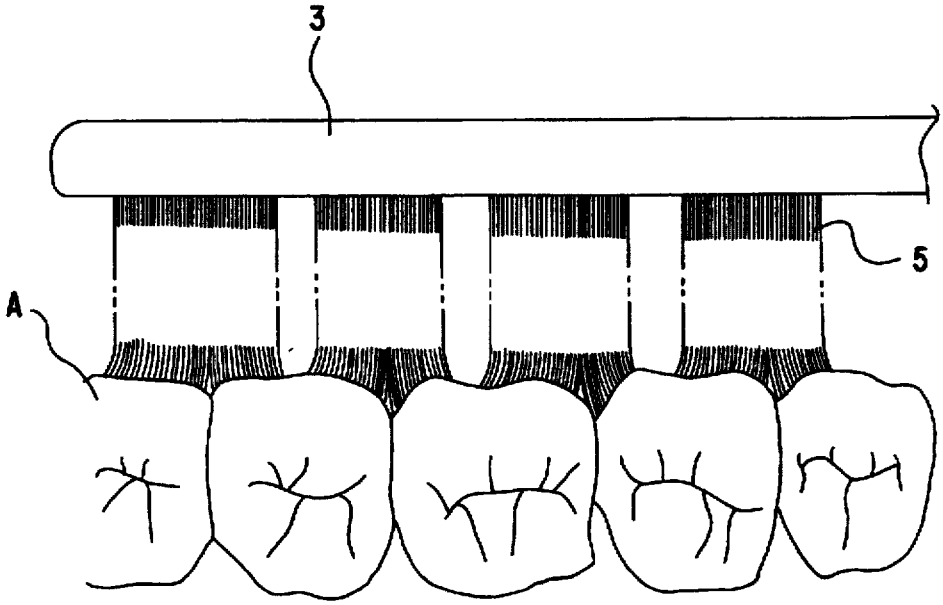
FIG. 11 is a plan view illustrating the state that the tufting area touches the teeth surface.
Figure 12:
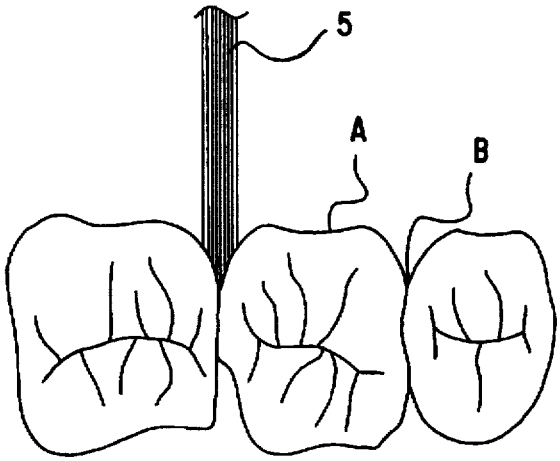
FIG. 12 is a plan view illustrating the state that the converging portion of a wide tuft enters into an interdental space.
Figure 13:
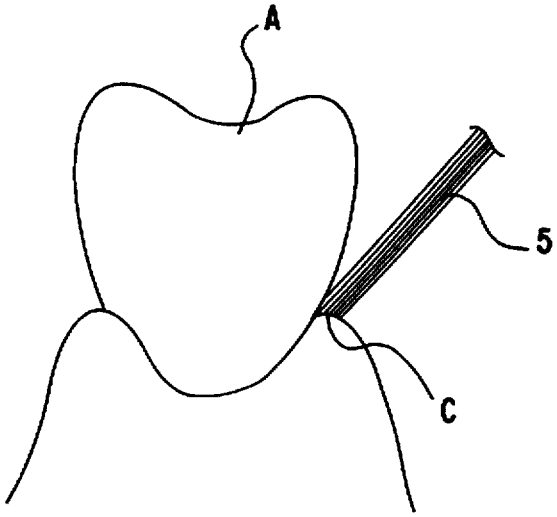
FIG. 13 is a front view illustrating the state that the converging portion of a wide tuft enters into a cervical margin.

That type of toothbrush is particularly suitable for brushing by a scrubbing method. According to the scrubbing method, the longitudinal direction of the handle is fit for the direction of dentition, and the brushing face of the tufts is pressed against the teeth surface while keeping the direction of matching, then the tufts are finely reciprocated in mesial and distal line directions. The brushing method performs most effective brushing against the teeth surface and most effective plaque removal. That is, the toothbrush has wide tufts 5 at the body portion 3a of the tufting area 2 so that the gap between tufts is small, which arrangement performs simultaneous contact of lots of tufts to the teeth surface A as shown in FIG. 10 and FIG. 11, to achieve efficient brushing on the teeth surface. The converging portion 5a which is formed at the end portion of the wide tuft 5 enters into interdental space, as shown in FIG. 11, and the end of the tuft reaches deep into the interdental space to remove the plaque deposited therein. A similar effect is attained also to the cervical margin, and the converging portion 5a easily enters cervical margin C as shown in FIG. 13. Even when the scrubbing method is not applied, a simple brushing under a condition to match the major axis of wide tuft with the tooth axis allows the end of the tuft to reach deep into the interdental space B, as shown in FIG. 12.

Since the wide tuft 5 contains large number of filaments supporting one another, the stiffness as the total wide tuft 5 is strong, and the plaque removal efficacy is very high. Although the tuft is in a wide shape, the wide face does not extend to the whole length of the tufting base, and a plurality of wide tufts are arranged along the longitudinal direction of the tufting base. Accordingly, the wide tuft 5 is allowed to give adequate elastic deformation along the dentition, and the row of wide tufts 5 allows air permeation, which functions keeps the tufting area in clean state.

Since a densely gathered tufting portion is formed at the tip-thinning portion of the tufting base by the triangle arrangement of tufts each having large cross sectional area, the densely gathered tufting portion is used to scraping out the plaque deposited in interdental space and cervical margin, and further in deep section on occlusal surface of molar.

Hereunder, the description is made of another embodiment.

Figure 14:
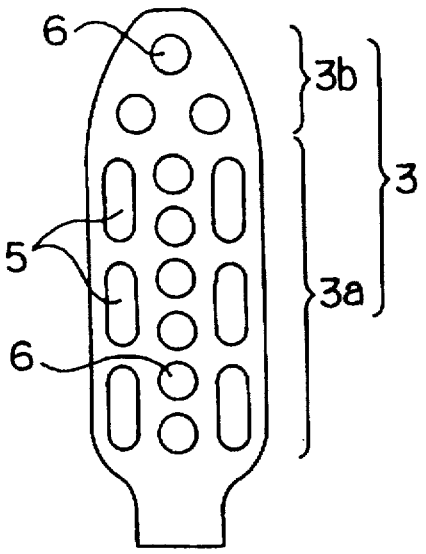
FIGS. 14(*a*) to 14(*c*) are front view illustrating the tufting area in which an arrangement of tufts at the tip-thinning portion is changed in accordance with another embodiment.
Figure 14:
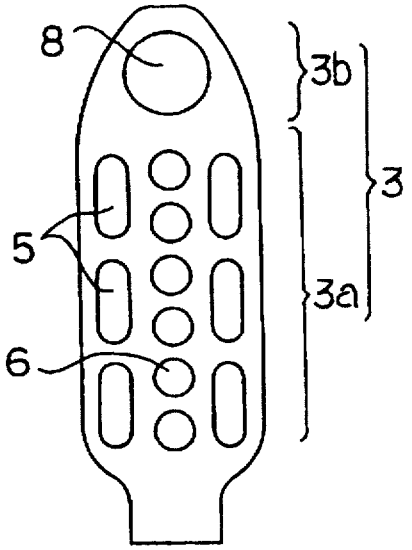
Figure 14:
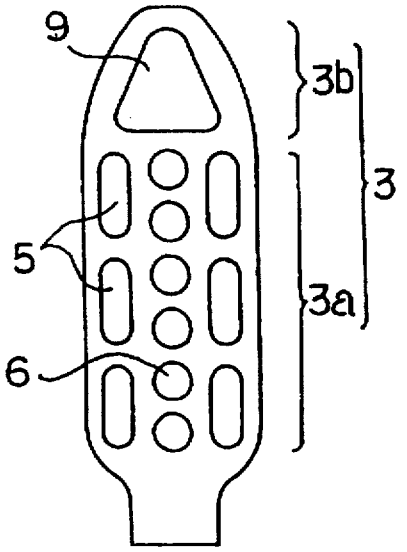

FIGS. 14(*a*) to (*c*) show different modes of tuft implanted to the tip-thinning portion 3b of the tufting base of the above-described toothbrush. FIG. 14(*a*) shows an arrangement placing round tufts 6 having ordinary size at the tip-thinning portion 3b. FIG. 14(*b*) shows an arrangement placing a single very thick round tuft 8. FIG. 14(*c*) shows an arrangement changing the single tuft in FIG. 14(*b*) to a tuft 9 having similar figures to the outer profile of the tufting base. All of these arrangements provide the plaque removal efficacy by the tuft implanted at the tip-thinning portion 3b adding to the plaque removal efficacy by the wide tufts 5 implanted in the tufting body portion 3a. Particularly in FIG. 14(*b*) and FIG. 14(*c*), since the single tuft is very thick, and the stiffness of the single tuft is very strong, the plaque removal efficacy is high. The filament structuring the large cross sectional tuft may be thin similar to that of filament structuring the wide tuft 5 to perform high plaque removal efficacy while keeping the soft touch to gingiva.

Figure 15:
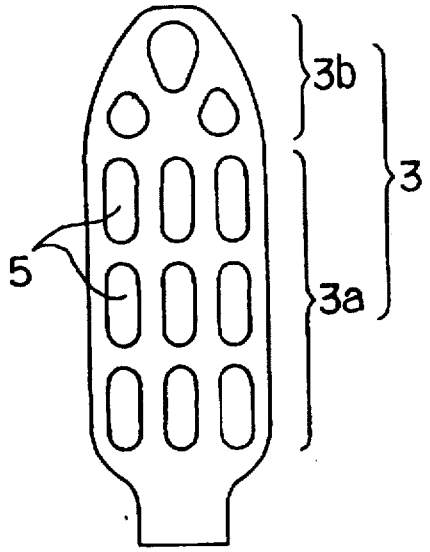
FIG. 15 is a front view illustrating the tufting area where all the tufts are wide tufts.

FIG. 15 shows an arrangement giving all the tufts on the body portion 3a of the tufting base are wide tufts.

Figure 16:
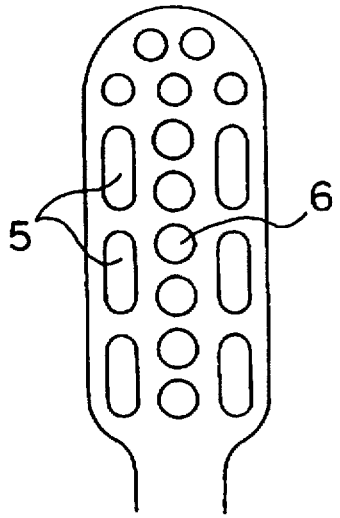
FIG. 16 is a front view illustrating the tufting area where the tufting base having a simple round tip-thinning portion is arranged with wide tufts.

FIG. 16 shows a tufting base having a tip-thinning portion. In that case, no fundamental difference occurs in terms of plaque removal efficacy with the wide tuft 5, though the positioning of the tip portion of the tufting base to a narrow region in deep part of oral cavity is not easy.

Figure 17:
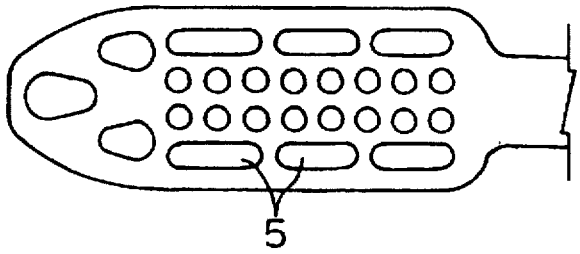
FIGS. 17(*a*) to 17(*c*) illustrate other examples of the present invention.
Figure 17:
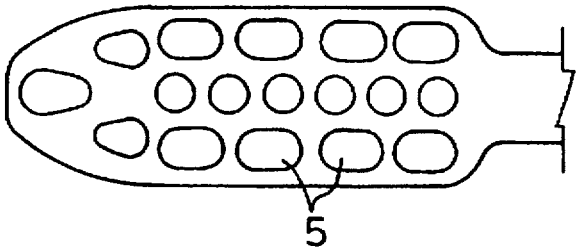
Figure 17:
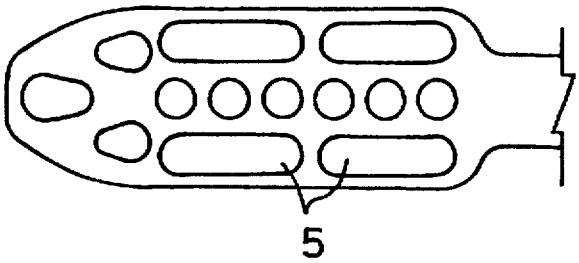

FIG. 17(*a*) shows an arrangement of four rows of tufts along lateral direction of the tufting base. FIG. 17(*b*) shows an arrangement of four wide tufts 5 along the longitudinal direction of the tufting base. FIG. 17(*c*) shows an arrangement of two wide tufts 5 along the longitudinal direction of the tufting base.

Figure 18:
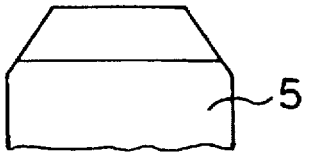
FIGS. 18(*a*) to 18(*c*) show a modification example of the converging portion formed at the tip of the wide tuft, where FIG. 18(*a*) is a front view, FIG. 18(*b*) is a side view, and FIG. 18(*c*) is a perspective view.
Figure 18:
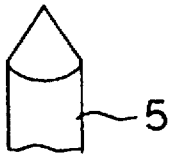
Figure 18:
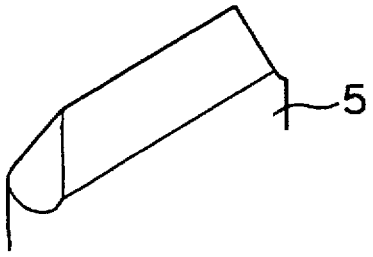
Figure 19:
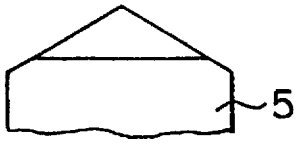
FIGS. 19(*a*) to 19(*c*) show a modification example of the converging portion formed at the tip of the wide tuft, where FIG. 19(*a*) is a front view, FIG. 19(*b*) is a side view, and FIG. 19(*c*) is a perspective view.
Figure 19:
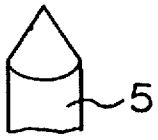
Figure 19:
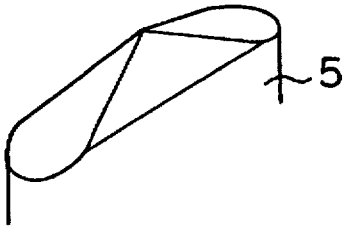
Figure 20:
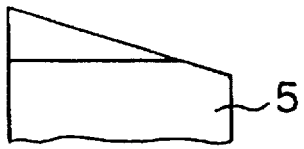
FIGS. 20(*a*) to 20(*c*) show a modification example of the converging portion formed at the tip of the wide tuft, where FIG. 20(*a*) is a front view, FIG. 20(*b*) is a side view, and FIG. 20(*c*) is a perspective view.
Figure 20:
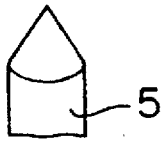
Figure 20:
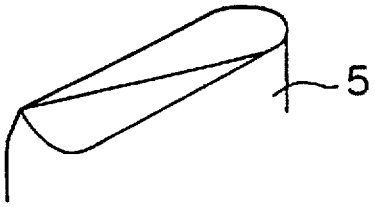
Figure 21:
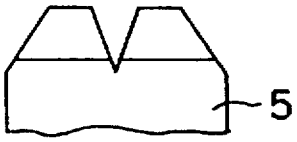
FIGS. 21(*a*) to 21(*c*) show a modification example of the converging portion formed at the tip of the wide tuft, where FIG. 21(*a*) is a front view, FIG. 21(*b*) is a side view and FIG. 21(*c*) is a perspective view.
Figure 21:
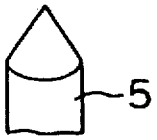
Figure 21:
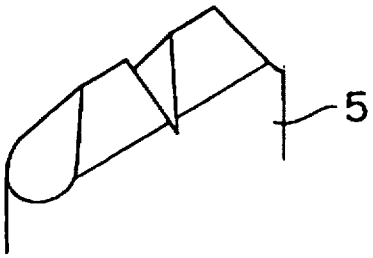
Figure 22:
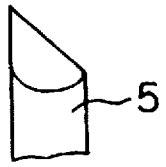
FIG. 22 is a side view of a modification example of the converging portion formed at the tip of the wide tuft.

Various profiles are applicable as the shape of converging portion formed at the tip portion of the wide tuft 5. For example, the converging portion having an end in line shape (FIGS. 18(*a*) to 18(*c*)), the one having an end in dotshape (FIGS. 19(*a*) to 19(*c*)), the one having an end skewed to raise toward an edge along wide axis of the tuft 5 (FIGS. 20(*a*) to (*c*)), the one having two end (FIGS. 21(*a*) to 21(*c*)) are applicable. An end portion having an end plane of specific area may be applicable (not shown). These converging portions are symmetrical to the centerline along the wide face direction of the wide tuft 5. However, as shown in FIGS. 22(*a*) to 22(*g*), the converging portion may be asymmetrical to the centerline along the wide face direction.

Figure 23:
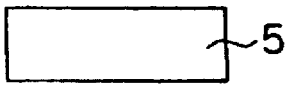
FIGS. 23(*a*) to 23(*g*) show a modification example of converging portion formed at the tip of the wide tuft.
Figure 23:
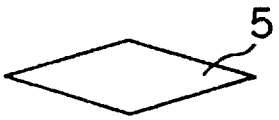
Figure 23:
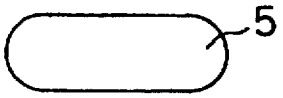
Figure 23:
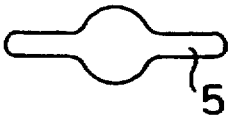
Figure 23:
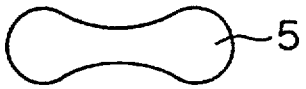
Figure 23:
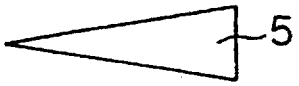
Figure 23:
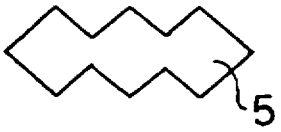

The root shape of the wide tuft 5 is also arbitrary. For example, various shapes may be applicable as illustrated in FIGS. 23(*a*) to 23(*g*). These illustrated root shapes are novel ones, and provide fresh design appearance. Various wide tufts having these tuft end portions and neck shapes are readily available by using, for example, the above-described tip profiling method and integral tufting during injection molding process.

Figure 24:
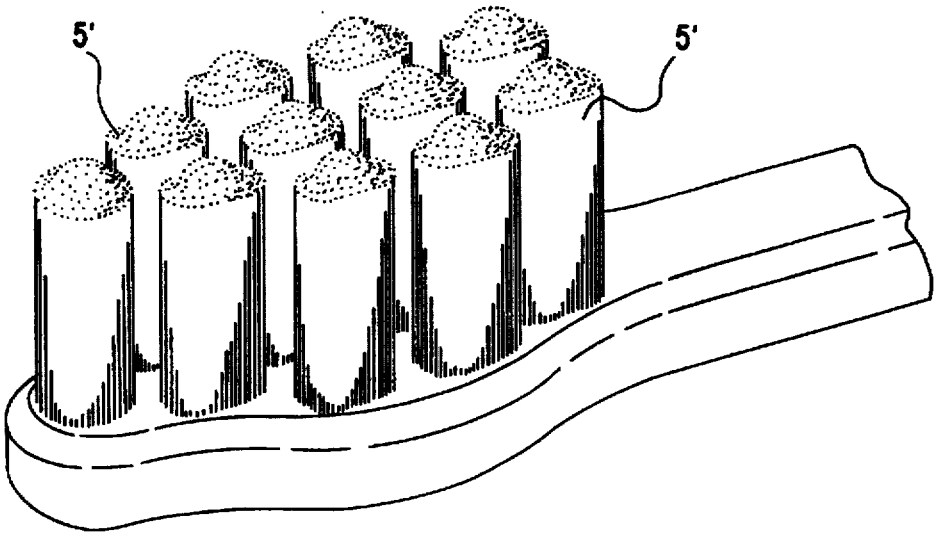
FIG. 24 is a perspective view showing the toothbrush according to another example of the present invention in which the converging portion having an approximately hemispherical shape is formed at the tip of the wide tuft.
Figure 25:
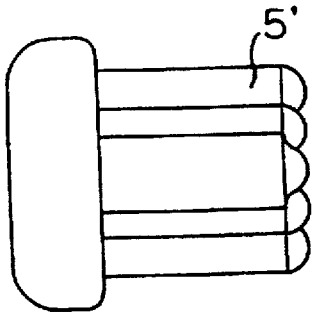
FIGS. 25(*a*) to 25(*c*) show the tufting area of the toothbrush according to the example shown in FIG. 24, in which the converging portion having an approximately hemispherical shape is formed at the tip of the wide tuft, where FIG. 25(*a*) is a side view, FIG. 25(*b*) is a front view, and FIG. 25(*c*) is a plan view.
Figure 25:
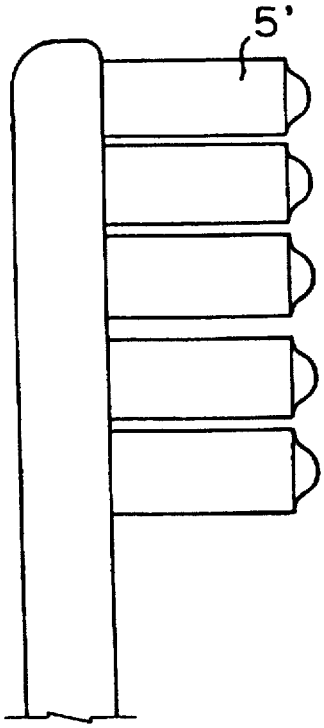
Figure 25:
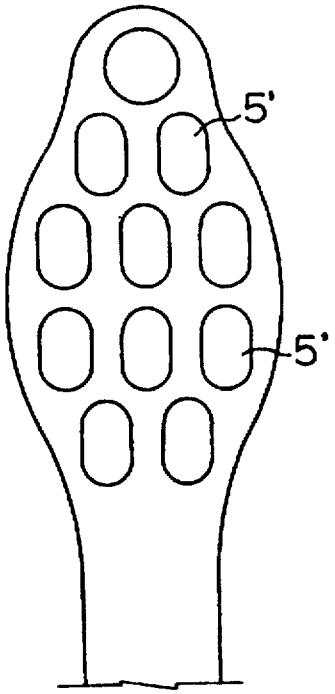

The above-described converging portions have a constant or nearly constant slope raising from the neck to the end thereof. The angle of slope, however, may be varied. FIG. 24 and FIGS. 25(*a*) to 25(*c*) show an example of varied slope angle at the converging portion. According to the example, the profile of converging portion formed at the tip portion of the wide tuft 5' has an approximately hemispherical shape which starts from the outer periphery of the tuft and converges to a single point while drawing a smooth curve. With that type of converging portion profile, the spherical surface touches the gingiva to press over a relatively wide area thereof without damaging thereto, which assures an excellent massage efficacy and superior cleaning effect on interdental papilla.

Figure 26A:
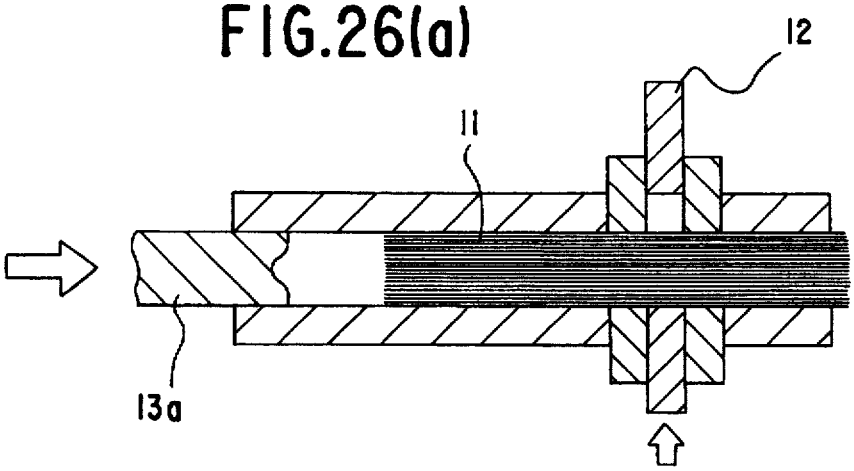
FIGS. 26(*a*) to 26(*c*) illustrate each step of the preparing method of forming the converging portion having an approximately hemispherical shape.
Figure 26B:
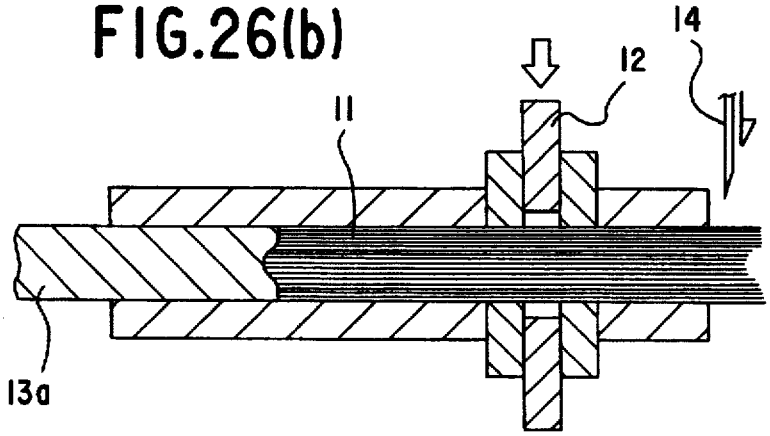
Figure 26C:
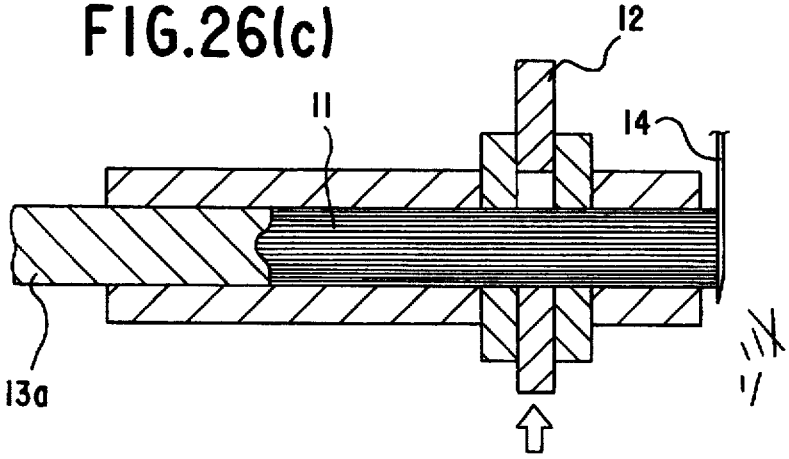
Figure 27:
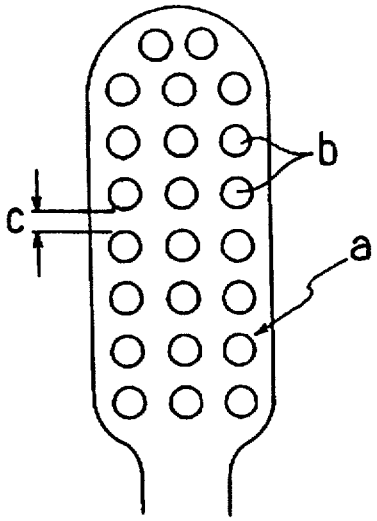
FIG. 27 is a front view showing the tufting area of a conventional toothbrush.
Figure 28:
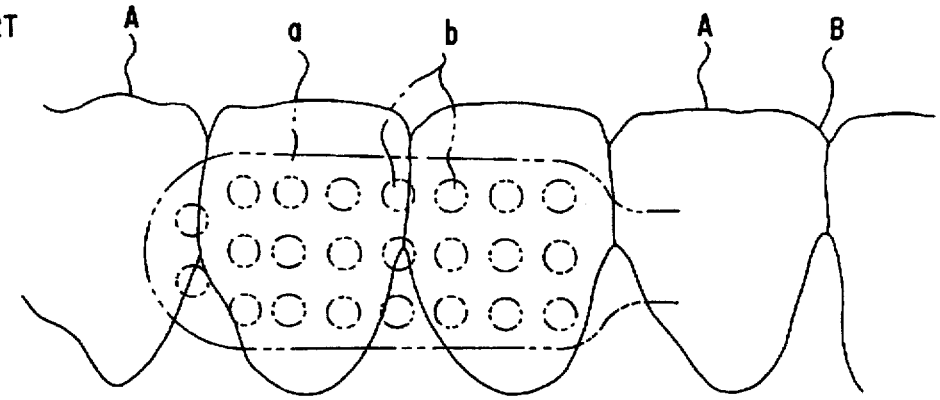
FIG.28 PRIOR ART
FIG. 28 is a front view illustrating the state that the tufting area of the conventional toothbrush contacts the tooth surface.
Figure 29:
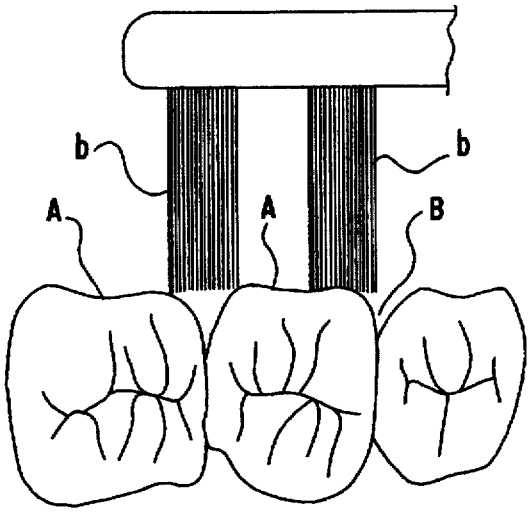
FIG.29 PRIOR ART
FIG. 29 is a plan view illustrating the state that the tufting area of the conventional toothbrush contacts the tooth surface.
Figure 30:
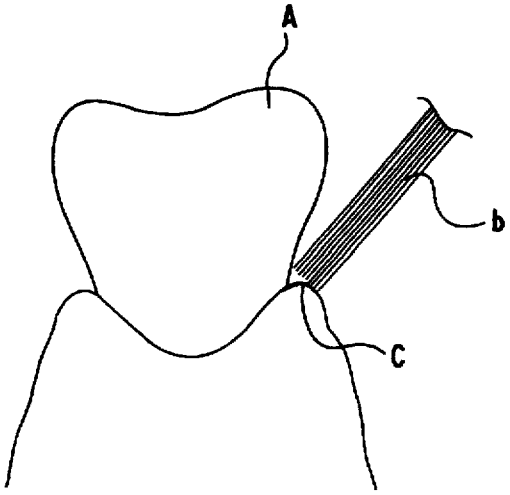
FIG.30 PRIOR ART
FIG. 30 is a front view illustrating the state that the tuft of the conventional toothbrush is hard to enter the cervical margin.

The forming method of that type of approximately hemispherical converging portion is similar with that of other converging portions described above. For example, as shown in FIGS. 26(*a*) to (*c*), a method to use a profiling rod 13*a* having a tip portion in a counter-shape to the near hemispherical target profile of the tuft.

[Embodiments]

To confirm the effect of the toothbrush according to the invention, a comparison test was conducted on plaque removal efficacy.

The test used a toothbrush according to the invention shown in FIG. 1 and a conventional toothbrush. The applied toothbrush according to the invention had the dimensions of 2.4 mm in major axis (w), 0.5 mm in minor axis (d), 4.6 mm in major axis (W), and 1.6 mm in minor axis (D), and 1.0 mm in height (h) at the converging portion, and had an arrangement of six rows of round tufts 6 in series, each tuft having 2 mm in diameter, (refer to FIG. 3), and had three thick tufts 7 each having 6.3 $mm^2$ of root area, (refer to FIG. 3).

The applied conventional toothbrush had round tuft with 1.9 mm in diameter and with a flat tip (straight cut profile) for all of the implanted tufts, and had simple round tip edge portion on the tufting base, not tip-thinning profile.

The test was conducted for 30 students of the department of dentistry, who were accepted as in relatively good oral hygiene condition. The selected target regions were (1) central incisor, (2) first premolar, (3) first molar, and (4) second molar. For each of the selected tooth, plaque score was determined at: two points on mesial and distal line angles of cheek and lips aspects; one point on middle line of cheek and lips aspects; two points on mesial and distal line angles of lingual and palatal aspects, and one point on middle line of lingual and palatal aspects; accounting for total six points. The average amount of plaque removal for each region or each tooth type was computed using the following equation.

"(Amount of plaque removal)=(amount of plaque score on the control toothbrush)—(amount of plaque score on the toothbrush according to the invention or on the conventional toothbrush)"

Total 30 subjects were divided into two groups each containing 15 subjects. Both groups used the control toothbrush for 3 days as a preparation period. Then, one group used the toothbrush according to the invention for 4 days, and the other group used the conventional toothbrush for 4 days. The plaque score was determined at the end of both the preparation period and the experimental period. Then, both groups used the control toothbrush again for 3 days as the preparation period, and each of the group used corresponding toothbrush which was different from that used in the preceding experimental period for 4 days. The plaque score was determined at the end of both the preparation period and the experimental period. The determination of the plaque score was conducted by dyeing the plaque with a plaque dye solution, and by applying a probe to each region. The probe was touched to the tooth surface in parallel direction to the tooth axis, and the determination was given in every 0.5 mm of plaque height from the cervical margin.

Although, the method and cycles of brushing were not specified, and the toothpaste applied through the test period was a toothpaste of low abrasive type with no claimed therapeutic agent. Result is shown in Table 2 and Table 3.

TABLE 2

| | Central incisor | First premolar | First molar | Second molar | Molar | Distal line angles of second molar |
|---|---|---|---|---|---|---|
| Example | 0.34 | 0.35 | 0.47 | 0.59 | 0.54 | 0.57 |
| Conventional Example | 0.26 | 0.22 | 0.37 | 0.39 | 0.38 | 0.32 |

TABLE 3

| | Total | Upper jaw | Lower jaw | Cheek and lips aspects | Lingual and palatal aspects | Angles | Center part of cervical margin |
|---|---|---|---|---|---|---|---|
| Example | 0.47 | 0.51 | 0.42 | 0.56 | 0.37 | 0.46 | 0.47 |
| Conventional Example | 0.34 | 0.38 | 0.29 | 0.33 | 0.35 | 0.35 | 0.29 |

(Unit: mm)

As shown in Table 2 and Table 3, the toothbrush according to the invention is extremely superior in the plaque removal efficacy at all the regions to the conventional toothbrush.

Since the toothbrush according to the present invention positions the wide tufts at the main part of tufting area and reduces the gap in the main part of the tufting area in the longitudinal direction thereof, the area of teeth surface contacting the tufts simultaneously is increased to allow efficient brushing on the teeth surface. Since the tip portion of the tuft is converged, the tip portion of the tuft easily reaches the interdental space and the cervical margin, and readily scrapes out the plaque deposited on these regions, thus efficiently removes the plaque on all oral regions such as teeth surface, interdental space, and cervical margin.

Since a lot of filaments structuring the wide tuft support one another, the wide tuft provides strong stiffness as a whole, and effectively removes the plaque attached to the tooth surface while maintaining durability of the tuft.

According to the second aspect of the present invention, specifying individual dimensions of the converging portion in a specific range allows the end portion of the converging portion smoothly to enter the interdental space and the cervical margin to allow the tip to reach the deepest part of these regions, so that the plaque in these regions are effectively removed. The effect is particularly enhanced by brushing by the scrubbing method.

According to the third aspect of the present invention, the arrangement of wide tufts at the outermost periphery along the outer profile of the tufting base ensures the simultaneous contact of the whole wide tufts arranged at the outermost periphery of the tufting base to the teeth surface.

According to the fourth aspect of the present invention, thinner filament structuring the wide tuft than the filament structuring other tufts allows to keep the stiffness as the whole tufts while keeping soft touch to the gingiva so that excellent plaque removal efficacy is attained without damaging gingiva.

According to the fifth aspect of the present invention, when a plurality of wide tufts each having a converging portion having dimensions within the specified range are arranged on both edges of lateral direction of the tufting base along the outer profile of thereof and when a plurality of round tufts each of which has 1.6 to 2.0 mm of neck diameter are arranged along the longitudinal direction of the tufting base at a lateral intermediate position between the wide tuft rows, the fabricated toothbrush has balanced functions that the plaque deposited on tooth surface and deposited in interdental space and cervical margin is effectively removed, and that the tufts have adequate flexibility to show elastic deformation along the ups and downs of the dentition surface.

According to the sixth aspect of the present invention, when the tip of the tufting base has a tip-thinning round edge, and when three tufts each of which has 4.0 to 10.0 $mm^2$ of root area are arranged at the tip-thinning edge part in a triangle arrangement while placing the apex of the triangle arrangement comes to the tip of the round edge of the tufting base, the tip-thinning round edge is easily pointed at an oral deep part, and the strong stiffness of the thick tuft implanted in the round edge area removes the plaque deposited at intricate regions of interdental space and cervical margin, further at occlusal surface of molar.

When a converging portion having an approximately hemispherical shape is formed at the tip of the wide tuft, the spherical surface touches the gingiva to press relatively wide area without damaging thereof, so that the excellent massage efficacy is attained and the superior cleaning effect is achieved at interdental papilla.

What is claimed is:

1. A toothbrush, comprising:

a handle portion;

a head portion connected to an end of said handle portion, said head portion constituting an elongated tufting base; and a plurality of tufts formed on said elongated tufting base, each tuft consisting of filaments vertically disposed on said elongated tufting base, wherein at least one of said plurality of tufts constituting a tufting area has a major axis extending along a longitudinal direction of said elongated tufting base and a minor axis perpendicular to said major axis, and a tip portion of said at least one of said plurality of tufts is converged toward a tip end of said tip portion to form a converged tip portion, said tip end has a shape selected from the group consisting of a dot, a line and a plane, wherein a size of said tip end of said converged tip portion is larger than 0 mm and not larger than 8 mm in said major axis (w) and larger than 0 mm and not larger than 3 mm in said minor axis (d), wherein a size of a basal end of said converged tip portion is from 3 to 10 mm in said major axis (W) and from 1 to 3 mm in said minor axis (D), and wherein a height (h) of said converged tip portion is from 0.5 to 4 mm.

2. A toothbrush according to claim 1, wherein said at least one of said plurality of tufts is arranged along an outer profile of said elongated tufting base at an outermost periphery of said tufting area.

3. A toothbrush according to claim 1, said filament constituting said at least one of said plurality of tufts is thinner than a filament in other tufts.

4. A toothbrush, comprising:

a handle portion:

a head portion connected to an end of said handle portion, said head portion constituting an elongated tufting base;

a plurality of wide tufts formed on said elongated tufting base, each wide tuft having a tip portion, and a plurality of round tufts formed on said elongated tufting base, wherein said plurality of wide tufts are oriented in a longitudinal direction of said elongated tufting base, wherein each said tip portion of said plurality of wide tufts is converged toward a tip end of said tip portion to form a converged tip portion, said tip end of said converged tip portion has a shape selected from the group consisting of a dot, a line and a plane, wherein said plurality of wide tufts are arranged on lateral sides of said elongated tufting base along a longitudinal direction of said elongated tufting base to form wide tuft rows.

wherein each of said plurality of wide tufts has a major axis extending along said longitudinal direction of said elongated tufting base and a minor axis perpendicular to said major axis, wherein a size of said tip end of said converged tip portion is larger than 0 mm and not larger than 8 mm in said major axis (w) and larger than 0 mm and not larger than 3 mm in said minor axis (d), a size of a basal end of said converged tip portion is from 3 to 10 mm in said major axis (W) and from 1 to 3 mm in said minor axis (D), a height (h) of said converged tip portion is from 0.5 to 4 mm, and wherein said plurality of round tufts each of which has 1.6 to 2.0 mm of neck diameter are arranged along said longitudinal direction of said elongated tufting base at a lateral intermediate position between said wide tuft rows.

5. A toothbrush according to claim 4, wherein said elongated tufting base has a tip-thinning edge part with a rounded edge, and further comprising three tufts each having 4.0 to 10.0 $mm^2$ of neck area are formed on said tip-thinning edge part, said three tufts are arranged at said tip-thinning edge part in a triangle arrangement with an apex of said triangle arrangement placed on a tip of said tip-thinning edge part.

6. A toothbrush, comprising:

a handle portion;

a head portion connected to an end of said handle portion, said head portion constituting an elongated tufting base; and a plurality of tufts formed on said elongated tufting base, each tuft consisting of filaments vertically disposed on said elongated tufting base, wherein at least one of said plurality of tufts constituting a tufting area has a major axis extending along a longitudinal direction of said elongated tufting base and a minor axis perpendicular to said major axis, and wherein a tip portion of said at least one of said plurality of tufts is converged toward a tip end of said tip portion to form an approximately hemispherical converging tip portion.

* * * * *